United States Patent [19]

Christian et al.

[11] 4,033,711

[45] July 5, 1977

[54] SPARK IGNITION GAS FLOW CONTROL SYSTEM

[75] Inventors: Joseph C. Christian, Norman, Okla.; Arthur J. Steele, Menlo Park, Calif.

[73] Assignee: Metrodata, Inc., Norman, Okla.

[22] Filed: Feb. 25, 1976

[21] Appl. No.: 661,297

[52] U.S. Cl. ..... 431/66

[51] Int. Cl.[2] ..... F23Q 3/00

[58] Field of Search ..... 431/66, 67, 79, 78

[56] References Cited

UNITED STATES PATENTS

| | | | |
|---|---|---|---|
| 3,410,646 | 11/1968 | Telford | 431/66 |
| 3,748,083 | 7/1973 | Finger | 431/66 |
| 3,887,325 | 6/1975 | Finger et al. | 431/66 X |
| 3,947,218 | 3/1976 | Landis | 431/79 |

*Primary Examiner*—Edward G. Favors
*Attorney, Agent, or Firm*—William R. Laney

[57] ABSTRACT

A spark ignition gas flow control system which includes an antenna responsive to spark-generated radio frequency waves, and a detector connected to the antenna and to a filter network. An amplifier network is connected to the filter network for receiving a filtered signal from the filter network and amplifying the received signal which is transmitted to a sensitive relay coil. The relay is operatively connected to a switch in a solenoid valve circuit. A solenoid valve in this circuit is disposed in a conduit supplying gas to a gas burner located in close proximity to a spark-generating device adjacent the antenna. The solenoid valve electrical circuit is closed to open the valve at a time when sparking is effected by the spark-generating device, and such sparking action is detected by the antenna. Thus, combustible gas is permitted to be discharged from the gas burner and ignited by the spark at this time. The solenoid valve circuit closes the solenoid valve in response to de-energization of the relay at a time when no sparking is detected by the antenna, indicating that gas cannot safely be discharged from the gas burner.

7 Claims, 1 Drawing Figure

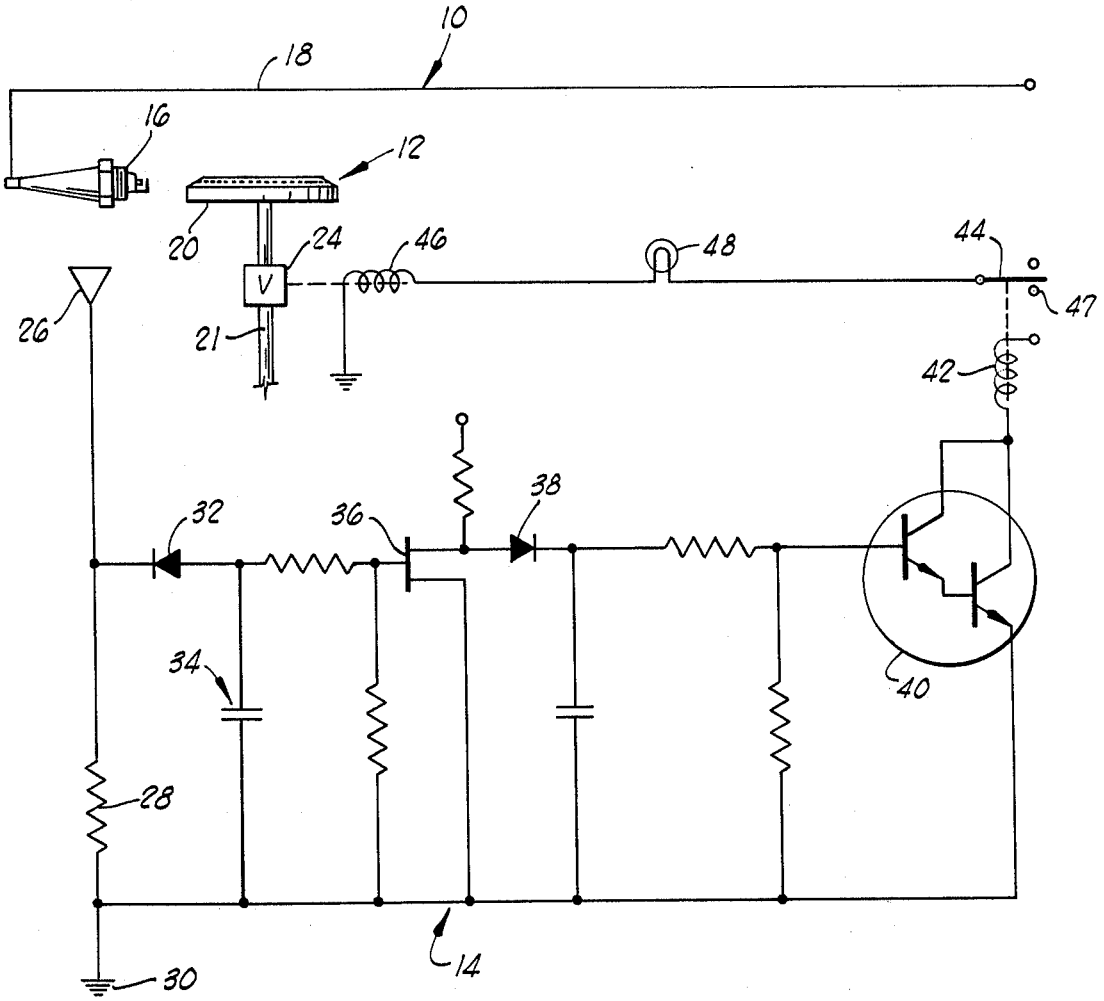
10
18
16
12
20
24
46
48
44
47
26
21
42
32
36
38
34
40
28
14
30

SPARK IGNITION GAS FLOW CONTROL SYSTEM

BACKGROUND OF THE INVENTION

1. Field of the Invention

The present invention relates to control circuitry utilized for automatically interrupting the flow of a combustible gas to a zone of ignition and combustion at such time as an igniting element used to ignite the gas as inactive. More particularly, the present invention relates to electrical control circuitry employed to continuously monitor and detect the status of a firing circuit used to develop sparks for the purpose of igniting combustible gas delivered to a gas burner in close proximity to the sparks, and providing a heat source as a result of combustion of the gas.

2. General Description of the Need

In a number of industrial devices, systems are provided which use as a heat source, a combustible gas, such as propane, which is burned upon ignition by an ignition spark provided adjacent a gas burner from which the combustible gas is discharged. A safety hazard is encountered in systems of this type in the event of malfunction of the firing circuit by which the spark is developed, in that the combustible gas may be inadvertently turned on or left on at a time when there is no source of ignition of the gas. This is often due to inactivation or failure of the firing circuit to provide the igniting spark, and the combustible gas discharges into the surrounding atmosphere and becomes admixed with the air in explosive proportion. It is often difficult to know, with certainty, without close scrutiny, whether the firing circuit by which the igniting spark is developed is operating properly. Moreover, with a careless operator of the system, the operator sometimes fails to energize the sparking circuit until gas has been discharging into the air adjacent the spark-generating device for several seconds.

3. Brief Description of the Present Invention

The present invention provides a spark-monitoring control system by which the flow of gas to a gas burner is controlled to assure that no gas escapes from the burner to the atmosphere when the firing circuit included in the system is inoperative to develop an igniting spark.

The invention can be broadly described as including an RF antenna positioned to detect radio frequency noise signals developed by the generation of a spark by a spark-generating device, which antenna is connected through a detector and filter network to an amplifier. The received signal is amplified and is employed to energize the coil of a sensitive relay. Energization of the relay closes a switch in a circuit containing a solenoid fuel valve. This status of the circuit energizes the normally closed solenoid control valve to open the valve, and permit fuel to flow to the burner where it is ignited by the spark. When the spark is inoperative, no signal is detected by the antenna, and the relay is not energized. Accordingly, the relay-operated switch in the solenoid valve electrical circuit remains open, and the solenoid valve remains de-energized and closed, thus preventing the discharge of combustible gas from the burner.

An important object of the invention is to provide a simple electrical circuit used in combination and association with a sparking device and a combustible gas burner to control the flow of gas to the burner in response to the operative status of the sparking device.

Another object of the invention is to improve the operational safety of heating devices which employ combustible gases ignited by a generated spark.

Additional objects and advantages of the invention will become apparent as the following detailed description of the invention is read in conjunction with the accompanying drawing which illustrates the circuitry used in conjunction with a gas burner and a spark-generating device in the present invention.

DETAILED DESCRIPTION OF A PREFERRED EMBODIMENT OF THE INVENTION

The spark detection gas control system of the invention is illustrated in the sole FIGURE of the drawing and includes a firing circuit, a portion of which is illustrated and designated generally by reference numeral 10. The system further includes a gas supply subassembly 12 and a spark detection and control circuit 14. The firing circuit can be variously constructed, but, in general, will include a spark-generating device, such as a spark plug 16, which is supplied by electrical power through a suitable lead 18. The spark plug 16 is disposed in close proximity to a gas burner 20 of conventional construction and provided with a plurality of apertures of perforations to permit gas to be discharged from the surface of the burner. The gas burner 20 is supplied with gas flowing through a suitable supply conduit 21 and, in accordance with the present invention, an electrically operated solenoid fuel control valve 24 is provided in the conduit 22 to control the flow of gas therethrough.

The detection and control circuit 14 of the invention includes an antenna 26 which is preferably a sensitive stub antenna of conducting material which is disposed sufficiently near to the spark gap of the spark plug 16 to detect radio frequency signals generated around a spark passing across the spark gap at a time when the firing circuit is energized. The antenna 26 is connected through a resistor 28 to ground 30. Detection of the received RF signal is accomplished by a diode 32 or other suitable rectifier. The signal from the diode detector 32 is filtered by the capacitor 34.

After the negative signal has been filtered, it is applied to the base of an N-channel junction field effect transistor (N-channel JFET) 36. A direct current power supply is connected to the amplifier network which includes the JFET 36, diode 38, and a Darlington pair NPN transistor 40. A double-pole, double-throw relay 42 is connected in the collector circuit of the Darlington pair. The double-pole, double-throw relay 42 includes a movable switch element 44 which is positioned in an alternating current electrical circuit supplying power to the coil 46 of the electrical solenoid fuel valve 24, and which closes this circuit by closing against a contact 47. The circuit containing the switch element 44 and solenoid valve 24 also preferably includes an indicator light 48 for indicating closure of the circuit by its illumination.

In the operation of the spark ignition gas flow control system of the invention, the stub antenna 26 functions to detect radio frequency signals generated by sparks developed by the spark plug 16. The signal as thus picked up by the antenna 26 is passed through the detector constituted by the diode 32 to the filter 34. A negative signal is then applied to the N-channel JFET 36 which is normally in conduction when there is no input signal from the filter network 34 resulting from detected sparking of the spark plug 16. When a negative signal is applied to the N-channel JFET 36, the signal is amplified and causes the coil of the relay 42 to be energized. The switch element 44 is then caused to close against the contact 47 to close the alternating current circuit to the coil 46 of the solenoid fuel valve 24. This valve is then moved to an open status to permit fuel to flow from the conduit 21 to the gas burner 20. The spark can thus ignite the fuel to develop the desired heat source.

At a time when the spark is not being generated, no RF signal is detected by the system, and the relay 42 remains de-energized. The alternating current circuit is thus permitted to remain open, the solenoid fuel valve 24 remains in its normally closed position, and no fuel is transmitted to the burner 20. There is thus positive assurance that there is no danger of escaping, unignited combustible gas mixing with the air to form a combustible or explosive mixture.

Although a preferred embodiment of the invention has been herein described, it will be understood that alterations or modifications in the described structural elements as illustrated in the drawing can be effected without departure from the basic principles underlying the invention. Changes and innovations of this type are therefore deemed to be circumscribed by the spirit and scope of the invention except as the same may be necessarily limited by the appended claims or reasonable equivalents thereof.

What is claimed is:

1. A spark ignition fuel flow system which comprises:
spark-generating means;
means for detecting a spark generated by said spark-generating means and providing a signal in response to said detection;
means connected to said detection means for amplifying a signal produced by said detection means, said amplifying means comprising:
an N-channel field effect transistor connected to said detecting means and normally electrically biased to a state of conduction when no signal is produced by said detecting means;
a Darlington pair transistor having the coil of said relay in the collector circuit thereof; and
a diode connected between said N-channel field effect transistor and said Darlington pair transistor to pass positive going direct current to said Darlington pair transistor when said field effect transistor is in the nonconducting state;
a fuel burner adjacent said spark-generating means for delivering combustible fuel to a situs for ignition by a spark generated by said spark-generating means; and
fuel flow control means connected to said amplifying means for permitting fuel to flow to said burner in response to an amplified signal developed by said amplifying means.

2. A spark ignition fuel flow control system as defined in claim 1 wherein said detecting means comprises an antenna adjacent said spark-generating means for detecting radio frequency signals produced when a spark is generated by said spark-generating means; and
a diode detector connected between said antenna and said N-channel field effect transistor.

3. A spark ignition fuel flow control system as defined in claim 2 and further characterized to include a visual indicator device connected in said electrical circuit and providing a visual indication of the closure of said circuit to open said solenoid valve.

4. A spark ignition fuel flow control system which comprises:
spark-generating means;
a radio frequency wave receiving antenna adjacent said spark-generating means for detecting radio frequency signals produced when a spark is generated by said spark-generating means;
a diode detector connected to said radio frequency wave receiving antenna;
means connected to said detector for amplifying the signal detected by said antenna and diode detector;
a fuel burner adjacent said spark-generating means for delivering combustible fuel to a situs for ignition by a spark generated by said spark-generating means; and
fuel flow control means connected to said amplifying means for permitting fuel to flow to said burner in response to an amplified signal developed by said amplifying means.

5. A spark ignition fuel flow control system as defined in claim 4 wherein said fuel flow control means comprises:
a fuel supply conduit connected to said burner;
an electrical relay connected to said amplifying means; and
an electrical circuit including:
a solenoid valve positioned in said fuel supply conduit; and
a relay actuated, circuit closing switch positioned adjacent said relay for closure to close said electrical circuit and open said solenoid valve when said relay is energized.

6. A spark ignition fuel control system for use in a locus in which spark-generating means forming a part of the system is exposed to sunlight comprising:
spark-generating means;
a radio frequency wave receiving antenna adjacent said spark-generating means for detecting radio frequency signals produced when a spark is generated by said spark-generating means;
a diode detector connected to said radio frequency wave receiving antenna;
means connected to said detector for amplifying the signal produced by said antenna and detector;
a fuel burner adjacent said spark-generating means for delivering combustible fuel to a situs for ignition by a spark generated by said spark-generating means;
fuel flow control means connected to said amplifying means for permitting fuel to flow to said burner in response to an amplified signal developed by said amplifying means, said fuel flow control means comprising:
a fuel supply conduit connected to said burner;
an electrical relay connected to said amplifying means; and
an electrical circuit including:
a solenoid valve positioned in said fuel supply conduit;
a relay-actuated, circuit-closing switch positioned adjacent said relay for closure to close said electrical circuit and open said solenoid valve when said relay is energized; and
a visual indicator device connected in said electrical circuit and providing a visual indication of the closure of said circuit to open said solenoid valve.

7. A spark ignition fuel flow control system as defined in claim 6 wherein said amplifying means comprises an N-channel field effect transistor connected to said diode detector and normally electrically biased to a state of conduction when no signal is produced by said detecting means and having an output connected to said electrical relay.

* * * * *